US005988737A

United States Patent [19]

Tomaiuolo

[11] Patent Number: 5,988,737

[45] Date of Patent: Nov. 23, 1999

[54] CONVERTIBLE BEACH CHAIR

[76] Inventor: Theodore Tomaiuolo, 114 Bohemia St., Plainville, Conn. 06062

[21] Appl. No.: 09/172,356

[22] Filed: Oct. 14, 1998

Related U.S. Application Data

[60] Provisional application No. 60/065,819, Nov. 14, 1997.

[51] Int. Cl.[6] ..... A47C 13/00

[52] U.S. Cl. ..... 297/129; 297/37; 297/31; 297/183.5

[58] Field of Search ..... 297/16.1, 37, 31, 297/129, 188.08, 115, 116, 117, 378.1, 183.5; 224/155; 280/30

[56] References Cited

U.S. PATENT DOCUMENTS 2,575,953 11/1951 Haley et al. .
5,016,792 5/1991 Jay .
5,062,650 11/1991 Chang .
5,139,308 8/1992 Ziman .
5,289,958 3/1994 Jay .
5,511,849 4/1996 Cahaley et al. .
5,931,526 8/1999 Tseng .

*Primary Examiner*—Milton Nelson, Jr.
*Attorney, Agent, or Firm*—Alix, Yale & Ristas, LLP

[57] ABSTRACT

A chair which can be converted from an upright-sitting condition into either a transport condition for hauling bulky items from one location to another or a compact storage condition. The convertible chair includes a pivotable back assembly, right and left arm assemblies, a seat assembly and a pivotable front leg assembly. In order to assist in transport, the chair can optionally employ wheels and/or associated sand skis designed to glide across a surface such as grass or beach sand.

20 Claims, 5 Drawing Sheets

CONVERTIBLE BEACH CHAIR

CROSS-REFERENCE TO RELATED APPLICATION

This application claims priority under 35 U.S.C. §119(e) based on U.S. Provisional Application No. 60/065,819 filed on Nov. 14, 1997.

BACKGROUND OF THE INVENTION

1. Field of the Invention

The present invention is directed to the field of convertible chairs. More particularly, the invention is directed to a convertible chair which can be reconfigured between multiple conditions including an upright-sitting condition, a transport condition and/or a storage condition. Accordingly, the general objects of the invention are to provide novel and improved methods and apparatus of such character.

2. Description of the Related Art

Collapsible chairs are well known in the art. Some widely known chairs of this nature include folding lawn furniture and beach chairs. Such chairs provide the advantage of space efficient transport and storage by being collapsible while also offering simple conversion into an effective upright condition for sitting. However, most of these designs have only offered convertibility between a substantially flat storage position and an upright-sitting position. Other designs have concentrated on offering a chair which can convert between an upright-sitting condition and a transport condition wherein the chair itself functions as a container for transporting objects. However, none of the above-described designs offer a chair with the ability to convert between three conditions: an upright-sitting condition, a transport condition and a storage condition.

SUMMARY OF THE INVENTION

It is accordingly a primary object of the present invention to provide a convertible chair with the ability to convert between an upright-sitting condition, a transport condition and/or a storage condition.

It is still another object of the present invention to provide a convertible chair which offers an optimal combination of (1) simplicity; (2) reliability; (3) economy; and (4) versatility.

These and other objects and advantages of the present invention are provided in one embodiment by a chair which converts from an upright-sitting condition into either a storage condition or a transport condition for the purpose of hauling bulky items from one location to another. In order to assist in transport, the inventive chair can optionally employ wheels and/or associated sand skis designed to glide across a surface such as grass or beach sand.

The inventive convertible chair includes a back assembly, right and left arm assemblies, a seat assembly and a pivotable front leg assembly. The back assembly preferably nests between and is supported by arm assemblies when the chair is in the upright-sitting condition.

To convert the chair from an upright-sitting condition to the transport condition, the back assembly is pivoted about an intermediate point and fastened to the arm assemblies and the front leg assembly is pivoted to a retracted position below the seat assembly.

If, instead, the chair is converted from the upright-sitting condition to the storage condition, the back assembly is pivoted about a lower end thereof until it confronts the seat assembly. The front leg assembly is also pivoted to the retracted position against the seat assembly during this conversion. Finally, the arm assemblies are pivoted inwardly toward the seat assembly to a horizontal position. The chair can, thus, be stored with a minimum of space.

Numerous other advantages and features of the present invention will become apparent to those of ordinary skill in the art from the following detailed description of the preferred embodiment, from the claims and from the accompanying drawings.

BRIEF DESCRIPTION OF THE DRAWINGS

The above-described structure, conditions and conversions are illustrated with respect to the preferred embodiments in FIGS. 1–5 wherein like numerals represent like structures and wherein.

DESCRIPTION OF THE PREFERRED EMBODIMENT

Figure 1:
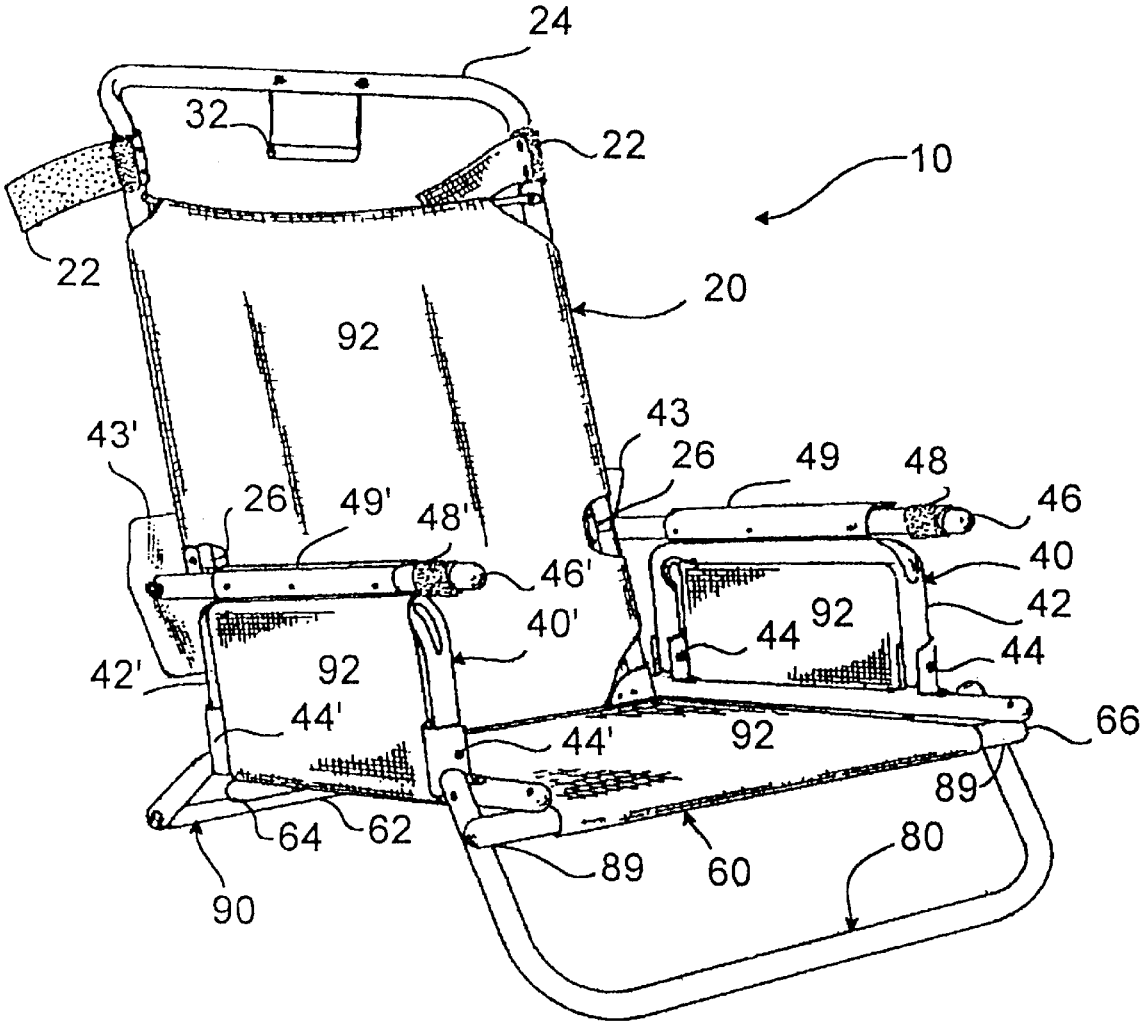
FIG. 1 shows a preferred embodiment of the inventive convertible chair in an upright-sitting condition.

With joint reference to FIGS. 1 through 4, the preferred embodiment of the inventive convertible chair takes the form of a beach chair 10 which includes a back assembly 20 with upper and lower portions 21 and 23, right and left arm assemblies 40 and 40', respectively, a seat assembly 60 and a pivotable front leg assembly 80. The seat assembly 60 is preferably comprised of a U-shaped tubular frame 62 and two straight tubes 64 and 66 fastened to the U-shaped frame. The front leg assembly 80 is preferably pivotably attached to the seat assembly 60 and one of the straight tubular members 66 of the seat assembly 60 cooperates with the front leg assembly 80 to provide a pair of bearing points 89 between the front leg assembly 80 and the seat assembly 60 when the chair 10 is in the upright-sitting condition (FIG. 1). The front leg assembly 80 is preferably inclined with respect to the seat assembly 60 when the chair 10 is in the upright-sitting condition. A rear leg assembly 90 of the chair 10 is preferably integrally formed with and, thus, a portion of, the seat assembly 60.

The inventive chair 10 also includes symmetric right and left arm assemblies 40 and 40'. Each of the arm assemblies is preferably comprised of one U-shaped member 42, 42' which is pivotably affixed to the seat assembly by a pair of arm assembly hinge/stop brackets 44 and 44'. The brackets 44 and 44' allow the arm assemblies 40 and 40' to pivot between a vertical arm rest position (FIG. 1) and a collapsed position (FIG. 3*b*) in which each arm assembly lies generally flat against the seat assembly 60. Each pair of brackets 44 and 44' is preferably provided with detents which firmly hold the arm assembly in the vertical position when the chair is in the upright-sitting condition (FIG. 1) and/or transport condition (FIG. 2*b*) to thereby prevent the arm assembly from "flopping around" when carried. A straight tubular member 46 and 46' is preferably fixed along the length of the U-shaped member of each arm assembly. One end of the straight member overhangs the front of the U-shaped member and could include a complementary fastener 48 and 48' (such as a VELCRO™ brand strap) for cooperation with fasteners 22 (such as VELCRO™ brand straps) provided on the back assembly 20. Arm comfort rests 49 and 49' are preferably mounted along the length of the straight member to present a comfortable surface to a user's arms when the chair is in the upright-sitting condition. An opposite end of the straight member extends beyond the U-shaped member and is preferably provided with a pivotable sand ski 43 and an associated wheel assembly 45 (see especially FIG. 4) which can be used when the chair is in the transport condition. The wheel assembly includes a wheel which is designed to rotate around an axle 41 transversely extending from the straight member (FIG. 4).

Figure 3A:
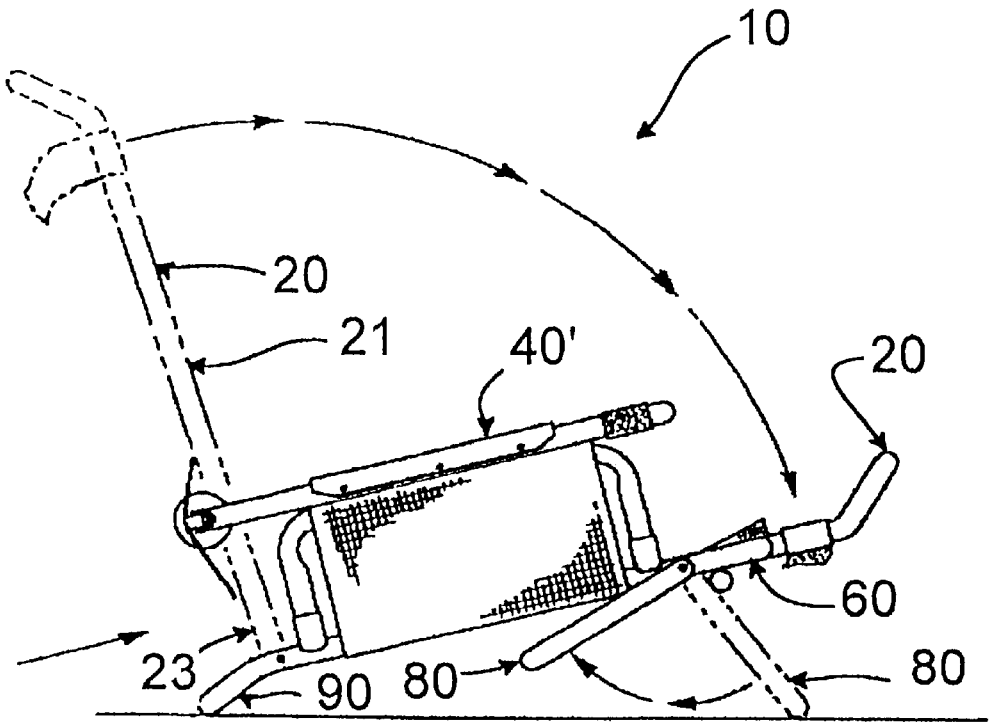
FIGS. 3*a* and 3*b* illustrate conversion of the preferred chair from the upright-sitting condition to a storage condition.
Figure 4:
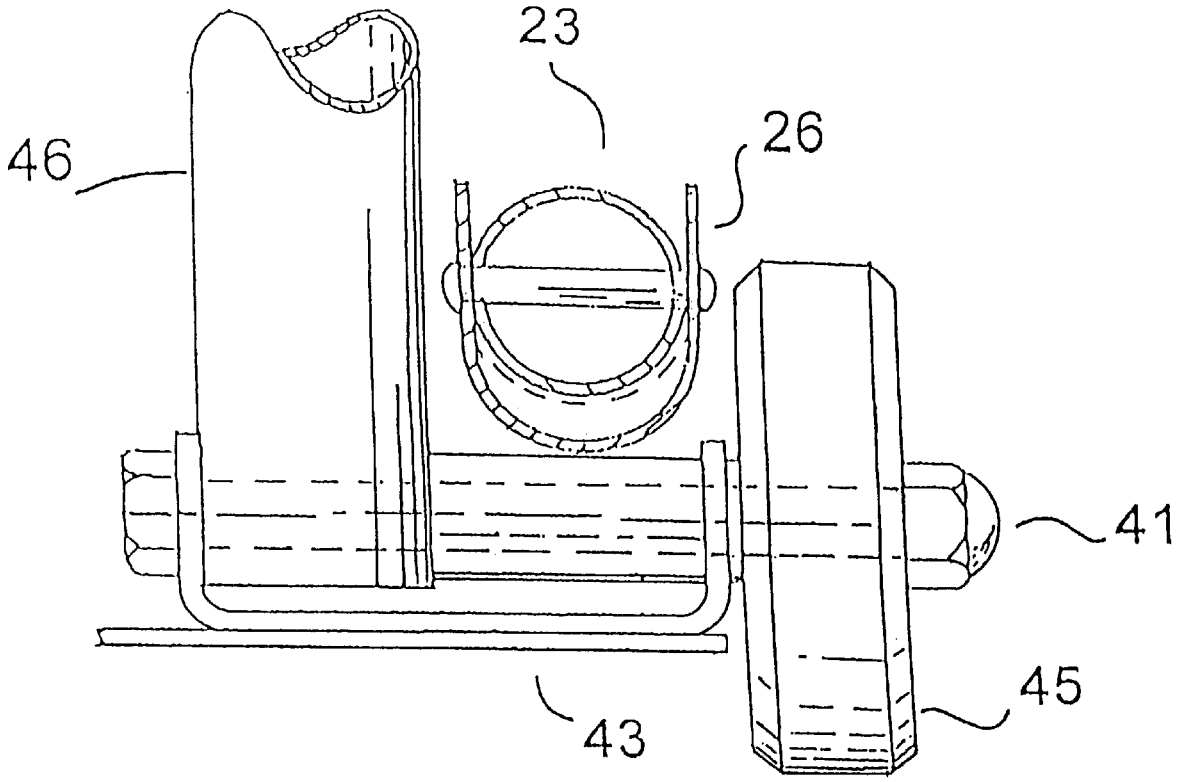
FIG. 4 is a more detailed view of the cooperation between a back assembly and an arm assembly of the preferred chair.

The back assembly 20 preferably nests between the straight members 46 and 46' and the wheel assembly 45 of the arm assemblies 40 and 40' when the chair is in the upright-sitting condition (FIGS. 1 and 4). The back assembly 20 comprises the U-shaped frame assembly 24 with two back assembly hinge/stop brackets 26 (each preferably providing dual pivot points, but alternatively each providing a single pivot point) between upper and lower portions 21 and 23. Back assembly 20 also comprises two shorter members extending parallel to the arms of the U-shaped frame, a transverse tubular member (at the bottom of the U-shaped frame) which extends transversely to and between the two shorter members and a transversely extending crossbar. While the two shorter members and the transverse member can be affixed together in a U-shape by fixed brackets, they could also be integrally formed members bent into a U-shape; the latter alternative being more cost effective. In the above-mentioned upright condition, bracket 26 of U-shaped frame assembly 24 bears against the axle 41 of the wheel assembly 45 (see FIGS. 3*a* and 4).

The back assembly is designed to tilt backward into an upright-sitting position as well as to fold at the hinge/stop brackets 26. Additionally, the upper portion 21 of back assembly 20 may be brought to a fully forward position where it faces the seat assembly 60 and, during such movement, the back assembly pivots about a lower point thereof (FIGS. 2*a* and 2*b*).

Figure 2B:
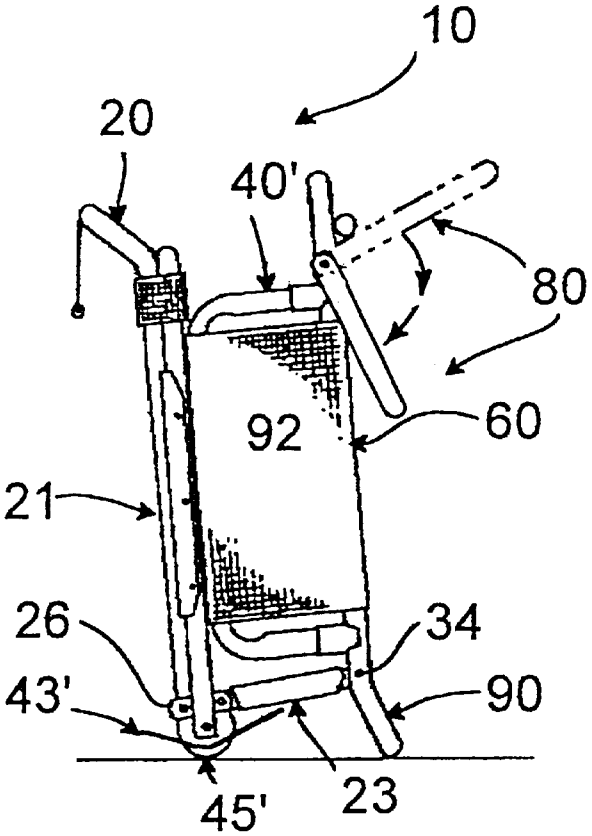
FIGS. 2*a* and 2*b* illustrate conversion of the preferred chair from the upright-sitting condition to a transport condition.
Figure 2A:
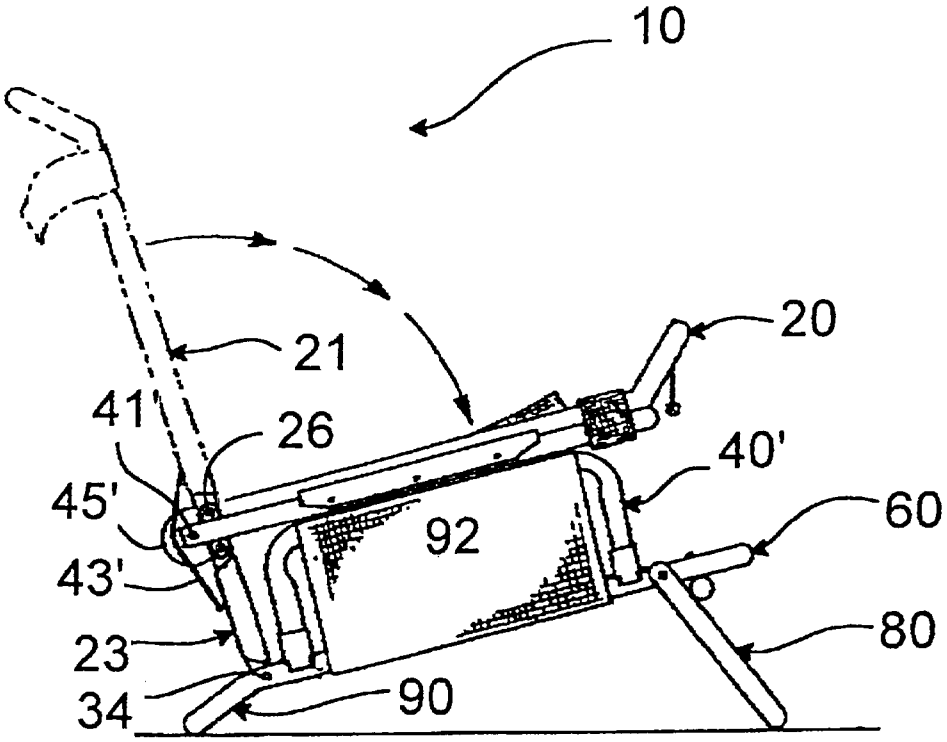
Figure 5:
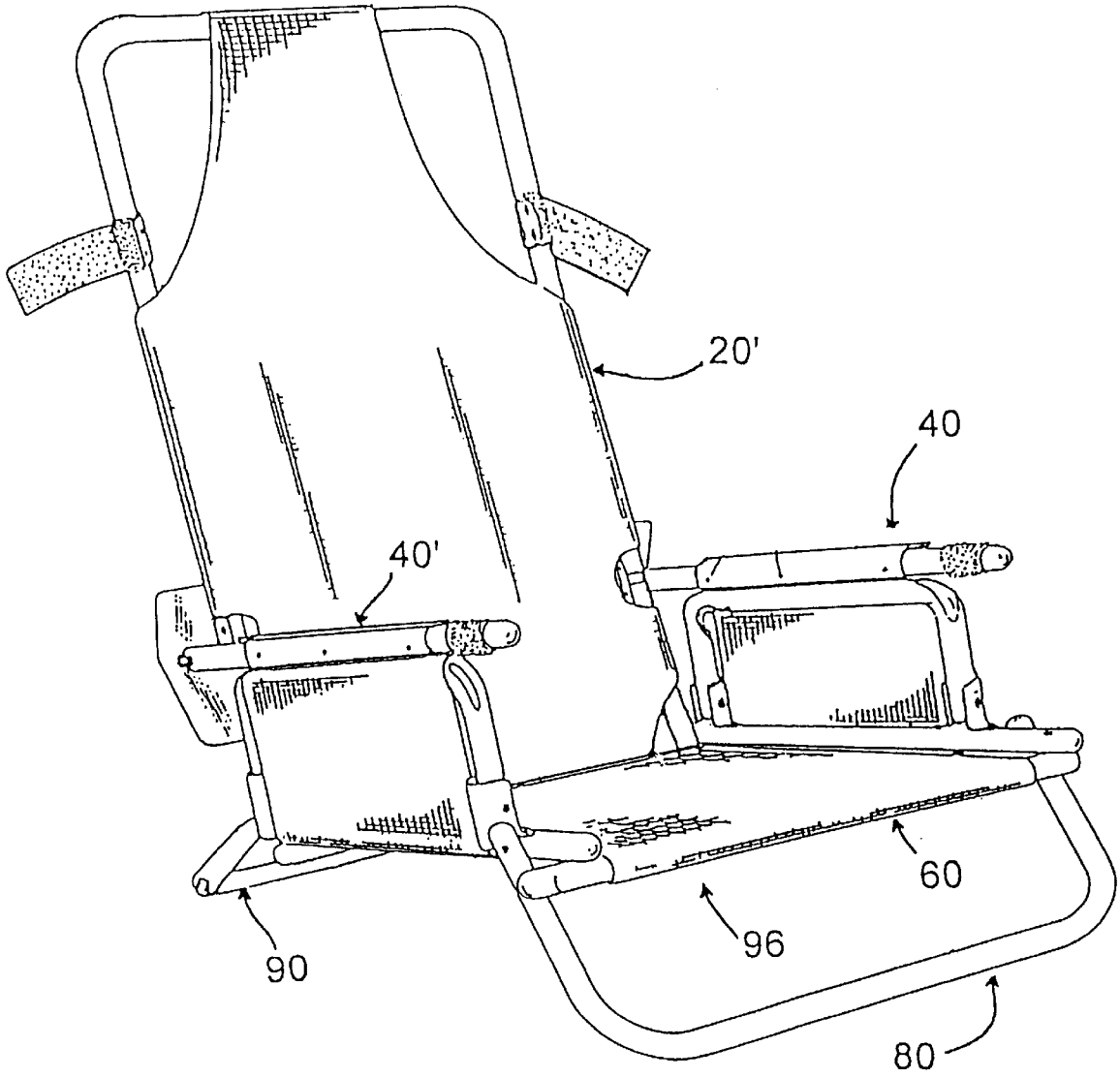
FIG. 5 shows an alternative embodiment of the inventive convertible chair in an upright sitting condition.

To convert the chair from the upright-sitting condition to the transport condition, the upper portion 21 of back assembly 20 is pivoted at the back assembly hinge/stop bracket 26, the fasteners 22 of the back assembly 20 are fastened to the complementary fasteners 48 and 48' on the arm assemblies 40 and 40', and the front leg assembly 80 is pivoted to a retracted position below the seat assembly 60 (FIG. 2*b*). When on solid and relatively smooth ground, the chair 10 can be wheeled using the wheels 45 of the arm assemblies. To this end, a tote handle 32 (FIG. 1) is provided at an upper end of the back assembly 20. Alternatively, the U-shaped tube 24 of the back assembly could be used as the handle. This is particularly true in an alternative embodiment wherein the top end of the U-shaped tube of the back assembly 20' is not curved but is straight (FIG. 5). This is also a simpler and more economical design feature. This alternative embodiment is otherwise substantially identical to the preferred embodiment.

Figure 3B:
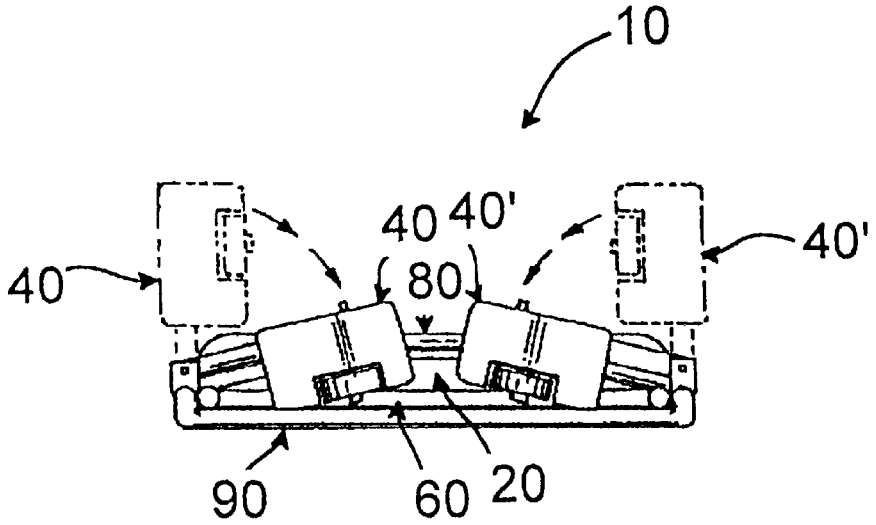

If, instead, the chair 10 is converted from the upright-sitting condition (FIG. 1) to the storage condition (FIG. 3*b*), lower portion 23 of the back assembly 20 is pivoted about a lower end thereof (preferably about an axis 34 parallel to the transverse tubular member) until it confronts the seat assembly (FIGS. 3*a* and 3*b*). The front leg assembly 80 is also pivoted to the retracted position against the seat assembly during this conversion. Finally, the arm assemblies 40 and 40' are pivoted to a horizontal position about the arm assembly hinge/stop brackets 44 and 44' (FIG. 3*b*). The chair 10 can, thus, be stored with a minimum of space.

The inventive chair 10 is also provided with support material 92 which is alternatively used to support a user's body (when the chair is in the upright-sitting condition) or to provide the sides of the utility cart (when the chair is in the transport condition). The support material 92 can be made from a wide variety of well known materials such as netting, straps of woven fabric, sheets of plastic, etc. A single piece of support material preferably extends below the seat and between the right and left arm assemblies (possibly affixed to the support material of the seat assembly at one end thereof) to form an auxiliary pocket 96 which provides extra storage space for books, magazines, etc. This material-overlap feature also provides added strength in the seat assembly and is a simple and economical design.

The various tubular components of the inventive chair can be made from a wide variety of well known materials such as plastic, steel and/or aluminum and fastened to the various other components using fasteners which are well known in the art. These fasteners could include clevis pins, welding, rivets, screws, bolts and/or any other fastener means well known in the art. Such fastener means can be used to provide either suitable pivot points or rigid connections as shown in the drawings and as desired. The fasteners 22 of the back assembly and complementary fasteners 46 and 46' expressly referenced in the description of FIGS. 1–3*a* are preferably VELCRO™ brand straps, but a wide variety of art recognized equivalents could also be used without departing from the spirit and scope of the invention. When utilizing metal tubes for various components of the chair 10 bent tubing is the preferred material. The preferred dimensions of the chair 10 are such that the chair preferably forms a transport container 8 inches by 21 inches by 22 inches when the chair is in the transport condition.

While, in the preferred form, the inventive chair is designed for use at the beach, those of ordinary skill will appreciate that it is not so limited. When in the transport condition, the inventive chair acts as a utility cart which can be used to transport beach accessories, such as blankets, beach balls, shovels and coolers of beer and hard cider from a user's car to a particular location on the beach, etc. Once at the desired site, the user can unload the supplies and set up the chair for sitting.

While the present invention has been described in connection with what is presently considered to be the most practical and preferred embodiment, it is to be understood that the invention is not limited to the disclosed embodiment, but is intended to cover the various modifications and equivalent arrangements included in the spirit and scope of the claims which will be appended hereto.

What is claimed is:

1. A convertible chair which can assume any one of an upright condition, a transport condition or a storage condition at any given time, said chair comprising:

a generally planar seat assembly having first and second sides;

a back assembly being no wider than said seat assembly and having upper and lower portions, said upper and lower portions being pivotable relative to one another and said lower portion being pivotably mounted to said seat assembly such that said back assembly can pivot into spaced substantially parallel relationship to said seat assembly in the transport condition, into inclined relationship to said seat assembly in the upright condition and into confronting relationship with said seat assembly in the storage condition;

first and second generally planar arm assemblies pivotably mounted to respective sides of said seat assembly such that said arm assemblies can pivot toward one another and toward said seat assembly; and front and rear leg assemblies extending below said seat assembly when said chair is in the upright condition.

2. The convertible chair of claim 1 further comprising flexible support material disposed on each of said back, seat and first and second arm assemblies such that each of said assemblies is substantially covered by said material.

3. The convertible chair of claim 1 further comprising first and second pivotable skis respectively disposed on said first and second arm assemblies.

4. The convertible chair of claim 1 wherein both of said upper and lower portions of said back assembly are at least generally parallel to said seat assembly when said chair is in said storage condition.

5. The convertible chair of claim 1 wherein both of said arm assemblies are at least generally perpendicular to said seat assembly when said chair is in the upright and transport conditions and wherein both of said arm assemblies are at least generally parallel to said seat assembly when said chair is in the storage condition.

6. The convertible chair of claim 1 wherein said upper portion of said back assembly is parallel to said seat assembly and said lower portion of said back assembly is perpendicular to said seat assembly when said chair is in said transport condition.

7. The convertible chair of claim 6 further comprising at least one fastener for rigidly maintaining said upper portion of said back assembly relative to said seat assembly and said arm assemblies when said chair is in said transport condition.

8. The convertible chair of claim 1 further comprising first and second rotatable wheel assemblies respectively disposed on said first and second arm assemblies.

9. The convertible chair of claim 8 wherein said first and second wheel assemblies are respectively disposed on pivot axles extending from said first and second arm assemblies and wherein said back assembly bears against said pivot axles when said chair is in said upright condition.

10. A convertible chair which can assume any one of an upright condition, a transport condition or a storage condition at any given time, said chair comprising:

means defining a generally planar seat assembly with opposing first and second sides;

means defining a back assembly, said means defining a back assembly including means defining upper and lower portions which are pivotable relative to one another, said means defining said lower portion being pivotably mounted to said means defining a seat assembly whereby said means defining a back assembly can pivot into spaced at least generally parallel relationship to said means defining a seat assembly in the transport condition, into non-parallel relationship to said means defining a seat assembly in the upright condition and into non-spaced at least generally parallel relationship to said means defining a seat assembly in the storage condition;

means defining first and second at least generally planar arm assemblies pivotably mounted to respective sides of said means defining a seat assembly whereby said means defining arm assemblies can pivot toward one another and toward said means defining a seat assembly; and means for supporting said chair when said chair is in the upright condition.

11. The chair of claim 10 further comprising means for fastening said means defining a back assembly to said means defining first and second arm assemblies when said chair is in said transport condition.

12. The convertible chair of claim 10, further comprising means for assisting movement of said chair when said chair is in said transport condition.

13. The convertible chair of claim 12 wherein said means for assisting comprises first and second rotatable wheel assemblies respectively disposed on said means defining first and second arm assemblies and wherein at lest one of said upper and lower back portions is capable of nesting in said first and second wheel assemblies.

14. The convertible chair of claim 12 wherein said means for assisting comprises first and second pivotable skis respectively disposed on said means defining first and second arm assemblies.

15. A convertible chair for transporting a user's possessions, for supporting a sitting user and for compact storage, said chair comprising:

a seat with first and second generally parallel sides;

a lower-back portion pivotably mounted to said first and second seat sides whereby said lower-back portion can pivot from an at least generally perpendicular position relative to said seat into an at least generally parallel position relative to said seat;

an upper-back portion pivotably mounted to said lower back portion whereby said upper-back portion can pivot from an at least generally co-planar position relative to said lower-back portion to an at least generally perpendicular position relative to said lower-back portion;

first and second arms pivotably mounted to respective sides of said seat whereby said arms can pivot from an at least generally perpendicular position relative to said seat to an at least generally parallel position relative to said seat; and legs extending from said seat for supporting said chair.

16. The convertible chair of claim 15 further comprising means for assisting movement of said chair when transporting a user's possessions.

17. The convertible chair of claim 15 further comprising means for rigidly fastening said upper-back portion to said first and second arms.

18. The convertible chair of claim 15 further comprising wheel assemblies extending from said first and second arms, wherein each of said wheel assemblies comprise a pivot axle and a wheel rotatably mounted to said pivot axle and wherein at least one of said upper and lower back portions is capable of bearing against said pivot axle.

19. The convertible chair of claim 15 wherein each of said seat, said lower-back portion, said upper-back portion and said arms include flexible support material disposed thereon.

20. The convertible chair of claim 19 wherein said flexible support material disposed on said seat is overlapped such that said material forms a pocket.

* * * * *